United States Patent [19]

Hemgren

[11] 4,267,949

[45] May 19, 1981

[54] DEVICE FOR SEPARATING TAPE PORTIONS FROM A TAPE OF FLEXIBLE MATERIAL

[75] Inventor: Sven A. Hemgren, Kungsängen, Sweden

[73] Assignee: Esselte Pendaflex Corp., Garden City, N.Y.

[21] Appl. No.: 80,311

[22] Filed: Oct. 1, 1979

[30] Foreign Application Priority Data

Oct. 4, 1978 [SE] Sweden ..... 7810397

[51] Int. Cl.[3] ..... B26F 3/02

[52] U.S. Cl. ..... 225/106; 225/9; 225/13

[58] Field of Search ..... 225/106, 13, 12, 9

[56] References Cited

U.S. PATENT DOCUMENTS 2,144,883 1/1939 Kind ..... 225/13 X
4,199,090 4/1980 Reed ..... 225/13

FOREIGN PATENT DOCUMENTS 826513 1/1952 Fed. Rep. of Germany ..... 225/106
841034 7/1960 United Kingdom ..... 225/13

*Primary Examiner*—Frank T. Yost

*Attorney, Agent, or Firm*—Gerald J. Ferguson, Jr.; Joseph J. Baker

[57] ABSTRACT

The invention concerns a device for separating tape portions of mutually equal length from a tape of flexible material. Said tape is provided with a plurality of slots spaced at mutually equal distances, said slots extending obliquely relative to the longitudinal direction of the tape substantially over the whole width thereof, so that short unslotted edge portions are left at each tape edge. Said tape passes through a guide channel along a first bottom portion thereof and over a steplike ledge at its end and below an adjacent elongated member which resiliently presses said tape into engagement with a subsequent second bottom portion of the guide channel. Said elongated member and said second bottom portion end at a distance from one sidewall of said guide channel and when the tape is pulled forth in the guide channel with its trailing unslotted edge portions along said sidewall, the tape tab defined by the foremost slot and extending against the pulling direction is moved to a position at the side of said second bottom portion and is displaced downwards below said bottom portion, so that the corresponding unslotted edge portion is torn off and the opposite unslotted edge portion thereafter is ruptured.

11 Claims, 4 Drawing Figures

DEVICE FOR SEPARATING TAPE PORTIONS FROM A TAPE OF FLEXIBLE MATERIAL

Figure 1:
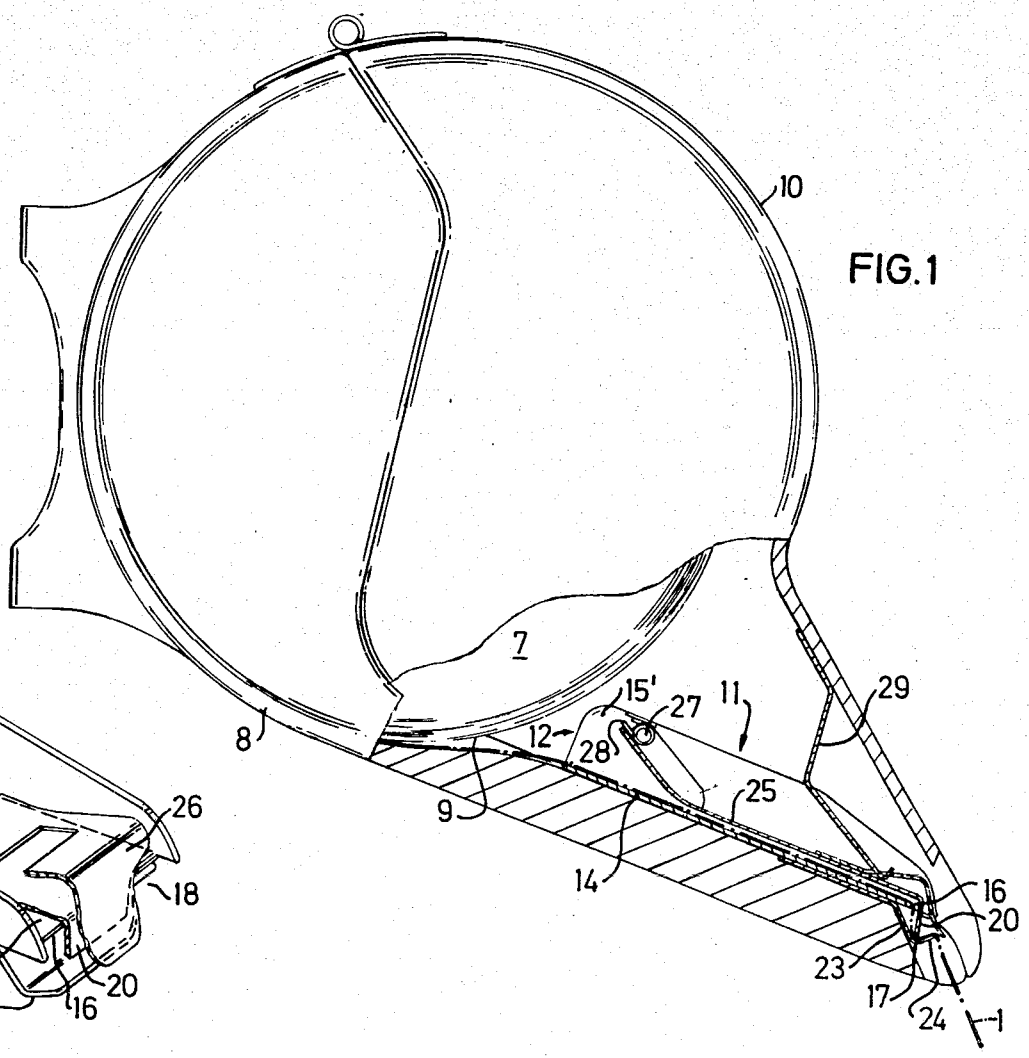

The present invention concerns a device for separating mutually similar tape portions from a tape of flexible material, for instance a tape of queue tickets.

Such devices are already known in a great number of different embodiments.

Some of these known devices are provided with means for stepwise advancement of the tape, which means by the aid of manual or engine power advances a length of the tape out from a carrier, said tape length thereafter being torn off against an edge or lip. These known devices are complicated and therefore expensive and are furthermore burdened with the disadvantage of requiring two manual actuations to separate each tape portion, namely a first manual actuation to start the means for stepwise advancement and a second manual actuation to tear off the advanced tape portion.

In another known device of this kind a fixed length of the tape end can be freely pulled out from a carrier, whereafter the advancement of the tape is arrested, for instance through engagement of a projection arranged in the carrier with an opening in the tape. When the advancement of the tape is suddenly arrested the outer end portion is torn off along a perforation. This known device is also of relatively complicated mechanical construction and furthermore it suffers from the disadvantage that the mechanical means are not always able to or do not have time to arrest the advancement of the tape, so that several connected tape portions are pulled out, if the advancement of the tape is too fast or occurs in a wrong direction.

In a further known device the tape is provided with a plurality of V-shaped slots which divide the tape into tape portions each of the same size. At each tape edge there is an unslotted edge portion between the ends of the slots and the tape edges. The outer end portion of a tape of this form arranged in a carrier is directed through a guide means in such a way that the unslotted edge portions of the tape, when the outer end portion thereof is pulled out, pass and are bent over lips, whereby the tab defined by the V-shaped slot of the subsequent tape portion follows a path which deviates from the path of the preceding tape portion. When a pair of unslotted edge portions of the tape reaches the lips they are torn off against said lips. The main disadvantage of this known device is that it does not always work in the intended manner, when the direction of advancement is wrong or the speed thereof is too great, so that several connected tape portions may be pulled out.

The object of the present invention is to provide a device of the kind stated, which is of a simple and cheap construction and which ensures the intended action so that always only one tape portion is separated. According to the invention this object is achieved by means of a device constructed as defined in the attached claims.

An additional advantage of the invention is that a tape roll of the size normally used at present may contain up to 20% more queue tickets than a tape for a known device of the last described type.

Figure 2:
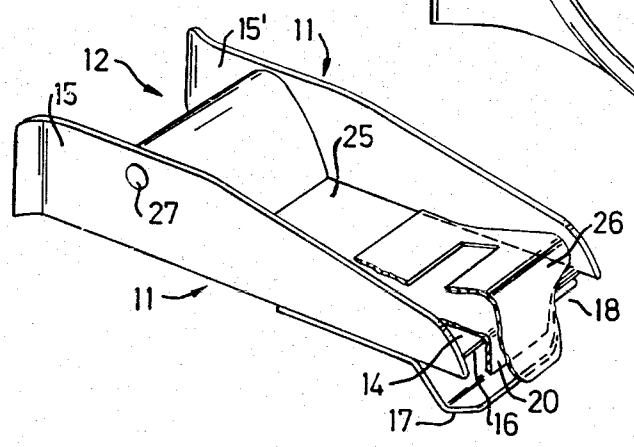
Figure 4:
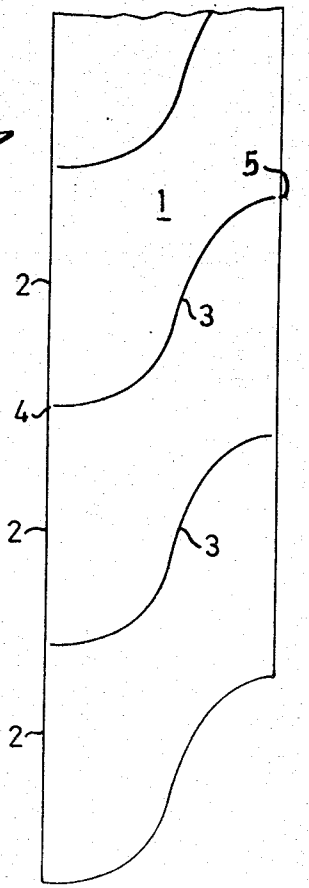
Figure 3:
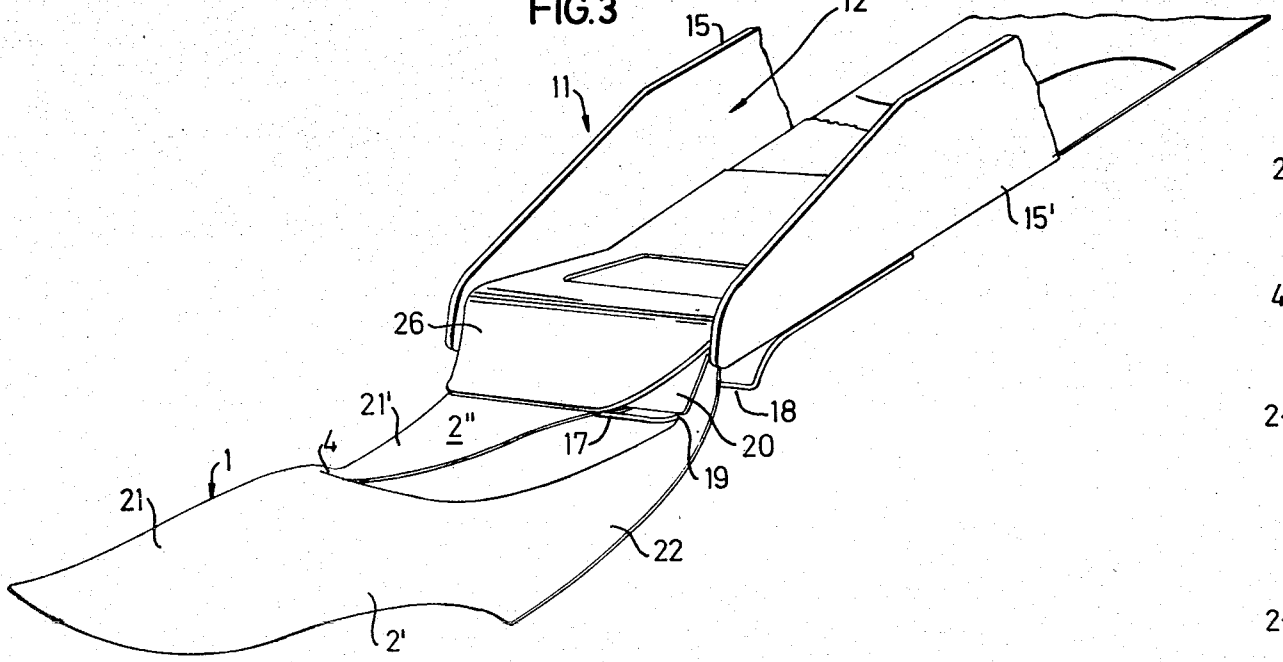

An embodiment of the invention will be described in detail below under reference to the attached drawings, of which FIG. 1 shows the device according to the invention in elevation and partly in section, FIG. 2 schematically shows a dispensing device in perspective as seen obliquely from above and partly in section, FIG. 3 shows the dispensing device in perspective as seen obliquely from above and FIG. 4 is a view of a part of a tape to be used in the device according to the invention.

According to FIG. 4 the tape 1 which preferably consists of paper is subdivided into tape portions 2 of mutually the same form and size by means of slots 3 which extend over the main part of the width of the tape 1 in a main direction which is inclined to the longitudinal direction of the tape. In the embodiment shown the slots 3 have a form with a slightly S-shaped curvature, which form has proved itself especially advantageous. The figure also indicates that unslotted edge portions 4 and 5 are left between the ends of each slot 3 and the adjacent tape edges, so that the tape portions 2 are connected to a continuous tape. Each tape portion 2 is furthermore provided with a text, for instance a queue number or the like. A suitable length of the tape 1 is in a known manner wound to form a roll 7 (see FIG. 1).

The device according to the invention comprises a carrier for a tape roll 7, said carrier preferably consisting of a bottom part in the form of a cradle 8 having a partly cylindrical channel or cavity 9 in which the tape roll 7 rests, and a top part in the form of a lid 10 which is swingably connected to the cradle 8 (see FIG. 1). When the lid 10 is swung up a tape roll 7 can be placed in the cavity 9 of the cradle 8, and when the lid is swung down the tape roll is completely accommodated in the carrier 8,10 and the outer free end of the tape then extends through a guiding and dispensing device 11, a description of which follows. In the swung down position said lid is lockable in a known manner to the cradle 8.

The guiding and dispensing device 11 for the tape 1 comprises a guide channel 12 having a first plane bottom portion 14 and upstanding sidewalls 15,15' arranged along the edges thereof. The guiding and dispensing device 11 is arranged in the cradle 8 in such a manner that said first bottom portion 14 slopes downwardly relatively the cradle from a level somewhat above the lowest point of the partly cylindrical cavity 9, whereby a rounded elevation is provided between said lowest point and the inlet end of the guide channel to direct the tape 1 into said guide channel along the first bottom portion 14 thereof. The outer end edge of the bottom portion 14 forms a steplike ledge 16 which extends over the whole width of the guide channel 12 and at the bottom edge the ledge goes over into a second bottom portion 17 of the guide channel 12. Said second bottom portion 17 has comparatively short length in the longitudinal direction of the guide channel and extends transversely over the guide channel 12 from one sidewall 15 thereof over more than half the width of the guide channel, but not up to the opposite sidewall 15' thereof. Said second bottom portion 17 is thus provided with a cut away portion 18 which at one side is defined by the sidewall 15' of the guide channel 12 and at the other side is defined by a side edge 19 of the bottom portion 17, said side edge 19 extending obliquely to the longitudinal direction of the guide channel 12 and being so formed that it substantially coinsides with the portion of a slot 3 in the tape 1, which portion passes over said side edge, when the tape is pulled forwards. The inner side of said cut away portion 18 is formed by the ledge 16.

An elongated member 20 is arranged above the second bottom portion 17 and is resiliently pressed against same immediately adjacent said steplike ledge 16. Said elongated member 20 extends from the sidewall 15 of the guide channel 12 up to the side edge 19 of the bottom portion 17.

When a tape 1 is placed in a guiding and dispensing device 11 of the above generally described construction, the outer end portion of the tape 1 extends along the first bottom portion 14 of the guide channel 12, over the top edge of the ledge 16 in abutment thereagainst over the whole tape width. The elongated member 20 engaging the top surface of the tape 1 thereby bends the tape 1 over the top edge of the ledge 16 down towards the second bottom portion 17 and presses the tape 1 against same. Since said second bottom portion 17 as described above has a cut away portion 18 at one sidewall 15' of the guide channel 12, the tape is only supported by the second bottom portion from the opposite sidewall 15 up to the side edge 19 of said second bottom portion 17. The tape 1 is placed in the guide channel 12 in such a manner that the leading unslotted edge portions 4 are situated adjacent the sidewall 15 and the trailing unslotted edge portions 5 are situated adjacent the sidewall 15' and therefore passes out over the cut away portion 18. An end tab 21 defined by a slot 3 thereby protrudes beyond the end edge of the second bottom portion 17 adjacent the sidewall 15.

When a tape 1 placed in this manner is pulled forward through the guide channel 12 by means of a pulling force in the protruding end tab 21, preferably substantially in the extension of the second bottom portion 17, the tape 1 slides forwards along the first bottom portion 14, over the edge of the ledge 16 and along the second bottom portion 17, a breaking or retarding frictional force being provided by means of the elongated member 20. When the foremost of the slanting slots 3 passes over the side edge 19 of the second bottom portion 17, the tab 22 which is directed upwards in the pulling direction and is defined by said slot 3 will move out over said cut away portion 18 of the second bottom portion 17 and the foremost tape portion 2' is thus not supported by the second bottom portion 17. Under the influence of the pulling force in the tab 21 of the tape and of the breaking frictional force from the elongated element 20 which in this position only acts on the end tab 21' of the succeeding tape portion 2'', the tape tab 22 extending upwards in the pulling direction is displaced downwards below the second bottom portion 17 of the guide channel 12 (see FIG. 3) and the corresponding unslotted edge portion 5 of the tape is thereby torn off against the edge of the ledge 16.

The tearing off is garantied by the fact that the full pulling force in this position is concentrated to the two unslotted edge portions 4 and 5. When said unslotted edge portion 5 has ruptured, the other unslotted edge portion 4 is subjected to the full pulling force and is also ruptured. When the outermost tape portion 2' has been separated, the end tab 21 of the following tape portion 2'' protrudes beyond the second bottom portion 17, so that said tape portion 2'' can be pulled out.

A guiding and dispensing device 11 of the above generally described construction works in an acceptable manner, but the embodiment shown comprises a number of further features which contribute to ensure that the device really works as described and also to facilitate the introduction of the tape 1 into the guiding and dispensing device 11.

The second bottom portion 17 is consequently formed with a comparatively shallow V-like cross section, one leg 23 of said cross section being connected to the underside of said first bottom portion 14 at some distance inside of its outer end. The second leg 24 of said cross section extends obliquely upwards and said elongated member 20 is arranged to engage the bottom of said V-shaped cross section. By means of said V-like form of the second bottom portion 17 the tape 1 is first directed downwards against said bottom and thereafter obliquely upwards therefrom, whereby the displacement downwards of the tape tab 22 extending opposite to the pulling direction is ensured and increased, so that the cooperating unslotted edge portion 5 of the tape without fail is torn off against the edge of the ledge 16.

A guide plate 25 is furthermore provided in the guide channel 12 to extend over the first bottom portion 14. The trailing end of said guide plate 25 is secured between the top edges of the sidewalls 15,15' of the guide channel 12. From said end the guide plate 25 extends obliquely downwards towards said first bottom portion 14 and thereafter it follows said bottom portion parallel thereto and spaced at a slight distance from same up to and somewhat beyond the ledge 16. The outer end portion of the guide plate 25 is bent down towards the second bottom portion 17 and constitutes said elongated member 20 which resiliently presses the tape 1 into engagement with said second bottom portion 17. The corners of the edges of said guide plate and the downwardly bent portion thereof are cut away, so that they do not extend out over the cut away portion 18 of the second bottom portion 17. A guide tongue 26 may be arranged on the topside of the outer end of said guide plate 25 in such a manner that it extends out over the outer end edge of said second bottom portion 17 at some distance therefrom. The guide tongue 26 also has a cut away portion at one end edge corresponding to said guide plate 25 and said second bottom portion 17.

The guide plate 25 may be fixed between the sidewalls 15,15' of the guide channel 12 and be flexible, so that the downwardly bent end portion 20 thereof engages the second bottom portion 17 by means of said flexibility. However, to facilitate the threading of the tape 1 through said guide channel 12 it is preferable to arrange the guide plate 25 for swinging movement between the sidewalls 15,15', for instance on a shaft 27 provided perpendicularly between said sidewalls. A spring 28 is provided between the guide channel 12 and the guide plate 25 and is arranged to swing the guide plate 25 upwards away from said guide channel 12. A second spring 29 which is intended to force the elongated element 20, i.e. the downwardly bent end portion of the guide plate 25, into resilient engagement with the second bottom portion 17 is provided in lid 10 of the carrier in a manner to act against the outer end portion of the guide plate 25 in the closed and locked position of the lid 10. When the lid 10 is swung upwards to enable the introduction of a new tape roll 7 into the cradle 8, said second spring 29 is lifted away from the guide plate 25, whereby said guide plate swings upwards a distance under the influence of the first spring 28, so that the distance of the guide plate 25 from the first bottom portion 14 is increased and the downwardly bent end portion 20 is lifted out of the V-shaped second bottom portion 17. A comparatively broad gap is thereby provided in the guide channel 12, through which gap the tape 1 can be inserted without difficulties. The spring 29 provided in the lid 10 is substantially stronger than the spring 28 swinging said guide plate 25 upwards to ensure that said guide plate 25 is retained in working position, when said lid 10 is locked to said cradle 8. The limits of the swinging movement of said guide plate 25 is defined by the engagement of the end portion 20 thereof with the second bottom portion 17, and a suitable stop member in the guide channel, respectively.

In a further not shown embodiment the introduction of the tape is facilitated by arranging the lower part of the guiding and dispensing device 11, i.e. the guide channel 12 with its sidewalls 15,15', the first bottom portion 14, the ledge 16 and the second bottom portion 17, in the cradle 8, whereas the upper part of said guiding and dispensing device 11, i.e. the guide plate 25 with its outer downwardly bent end portion serving as said elongated member 20 and the guide tongue 26, if same is present, is provided in the lid 10 of the carrier. Thus, when the said lid is swung up, the guide channel is fully open upwards, so that the tape 1 easily can be placed in the guide channel. When the lid 10 is swung down and is locked to the cradle 8, the tape 1 is pressed into a correct position by means of the guide plate 25 and the end portion 20 thereof. The resilient engagement of the tape 1 against the second bottom portion 17 is thereby preferably produced by forming said guide plate 25 and its end portion 20 resilient, so that no extra spring means are required.

What I claim is:

1. A device for separating tape portions of mutually equal length from a tape of flexible material, for instance a tape of queue tickets, characterized in that the device comprises a guide channel having a first plane bottom portion, which at one end thereof over a step-like ledge, extending transversely over the whole width of said guide channel, passes over into a second bottom portion provided with an obliquely cut away portion at one side of said guide channel, whereby said tape, which is provided with a plurality of slots, spaced at mutually alike distances from each other and extending obliquely to the longitudinal direction of the tape over the main part of the width thereof, so that short unslotted edge portions are left at each tape edge, is pullable along said guide channel in engagement with said first bottom portion, the edge of said ledge and the second bottom portion and is pressed into abutment with said second bottom portion immediately adjacent said ledge by means of an elongated, resilient member, the trailing, unslotted edge portions of the tape thereby passing in over said cut away portion of the second bottom portion, so that the leading tape portion is separated from the tape, when the intermediate slot passes in over said cut away portion.

2. A device as claimed in claim 1, characterized in that said second bottom portion is relatively short in the pulling direction and that said cut away portion thereof is defined by an edge of substantially the same form and extension as the part of the tape slots passing thereover.

3. A device as claimed in claim 1 or 2, characterized in that said second bottom portion has a V-shaped cross section and that said elongated, resilient member engages the bottom of said cross section.

4. A device as claimed in claims 1 or 2, characterized by a guide plate which bridges the whole width of said guide channel at a short distance above said first bottom portion and which is connected to the sidewalls of said guide channel at a distance above said ledge as seen in pulling direction, the leading end portion of said guide plate being bent down towards said second bottom portion to form said elongated, resilient member which is pressed into engagement with said bottom portion by means of a spring.

5. A device as claimed in claim 4, characterized in that the downwardly bent end portion of said guide plate has a cut away edge portion corresponding to the cut away portion of said second bottom portion.

6. A device as claimed in claim 4, characterized in that said guide plate at the leading end thereof is provided with a guide tongue, extending out over the outer edge of said second bottom portion.

7. A device as claimed in claim 4, characterized in that the slots subdividing said tape have a S-like curvature.

8. A device as claimed in claims 1 or 2, having a carrier for a tape roll, preferably consisting of a bottom part in the form of a cradle in which the tape roll rests and a lid which is hinged to said cradle to close same and is lockable to said cradle, characterized in that said guide channel with the elongated, resilient member is provided in said cradle, and a spring cooperating with said element is provided in said lid in order resiliently to load said member in the closed position of said lid.

9. A device as claimed in claim 8, characterized in that the guide plate serving as said elongated, resilient member is connected to said guide channel to be swingable away from same under the action of a second spring which is substantially weaker than the first mentioned spring provided in the lid to load said elongated, resilient member.

10. A device as claimed in claim 8, characterized in that the slots subdividing said tape have a S-like curvature.

11. A device as claimed in claims 1 or 2, characterized in that the slots subdividing said tape have a S-like curvature.

* * * * *